US009812066B2

(12) United States Patent
Kim et al.

(10) Patent No.: US 9,812,066 B2
(45) Date of Patent: Nov. 7, 2017

(54) ORGANIC LIGHT EMITTING DISPLAY AND DRIVING METHOD OF THE SAME

(71) Applicant: SAMSUNG DISPLAY CO., LTD., Yongin, Gyeonggi-Do (KR)

(72) Inventors: Cheol Min Kim, Seongnam-si (KR); Hyung ryul Kang, Seoul (KR); Se Byung Chae, Seoul (KR)

(73) Assignee: Samsung Display Co., Ltd., Yongin, Gyeonggi-do (KR)

( * ) Notice: Subject to any disclaimer, the term of this patent is extended or adjusted under 35 U.S.C. 154(b) by 274 days.

(21) Appl. No.: 14/680,518

(22) Filed: Apr. 7, 2015

(65) Prior Publication Data

US 2016/0155387 A1 Jun. 2, 2016

(30) Foreign Application Priority Data

Dec. 2, 2014 (KR) ..... 10-2014-0170287

(51) Int. Cl.
*G09G 3/20* (2006.01)
*G09G 3/3291* (2016.01)

(52) U.S. Cl.
CPC ..... *G09G 3/3291* (2013.01); *G09G 3/2092* (2013.01); *G09G 2300/0852* (2013.01); *G09G 2300/0861* (2013.01); *G09G 2310/0251* (2013.01); *G09G 2310/0262* (2013.01); *G09G 2310/0297* (2013.01); *G09G 2320/043* (2013.01)

(58) Field of Classification Search
CPC ..... G09G 3/3291; G09G 2300/0852; G09G 2300/0861; G09G 2310/0251; G09G 2310/0262; G09G 2310/0297; G09G 2320/043; G09G 3/3275; G09G 3/325; G09G 3/3233; G09G 3/3225; G09G 3/3208; G09G 3/32; G09G 3/30; G09G 3/2092; G09G 3/20; G09G 3/00; G09G 2320/04; G09G 2320/02; G09G 2320/00; G09G 2300/043
USPC ..... 345/76
See application file for complete search history.

(56) References Cited

U.S. PATENT DOCUMENTS 8,976,088 B2 * 3/2015 Han ..... G09G 3/3233 345/76
9,620,061 B2 * 4/2017 Cao ..... G09G 3/3258
(Continued)

FOREIGN PATENT DOCUMENTS

KR 10-2011-0127006 A 11/2011
KR 10-2011-0139005 A 12/2011
(Continued)

*Primary Examiner* — Julie Anne Watko
(74) *Attorney, Agent, or Firm* — Lee & Morse, P.C.

(57) ABSTRACT

An organic light emitting display includes a plurality of pixel row groups, a scan driver, a data driver, and a data distributor. Each pixel group includes the same number of pixel rows, and the pixel row groups are sequentially driven. The data distributor demultiplexes data signals for input into the pixels. The data signals are input to the pixels after threshold voltage compensation is performed at substantially a same time for pixels in each of the pixel row groups. Data signals are to be input to pixels in one pixel row group while threshold voltage compensation is performed for pixels in another pixel row group adjacent to the one pixel row group.

20 Claims, 11 Drawing Sheets

(56) References Cited

U.S. PATENT DOCUMENTS

| | | | | |
|---|---|---|---|---|
| 2007/0063958 | A1* | 3/2007 | Toyozawa | G09G 3/20 345/98 |
| 2009/0122053 | A1* | 5/2009 | Yamamoto | G09G 3/3233 345/213 |
| 2011/0115764 | A1* | 5/2011 | Chung | G09G 3/3233 345/205 |
| 2014/0340377 | A1* | 11/2014 | Kishi | G09G 3/3225 345/211 |
| 2016/0155379 | A1* | 6/2016 | Na | G09G 3/3233 345/215 |

FOREIGN PATENT DOCUMENTS

| | | | |
|---|---|---|---|
| KR | 10-2014-0053601 | A | 5/2014 |
| KR | 10-2014-0067406 | A | 6/2014 |
| KR | 10-2014-0137504 | A | 12/2014 |

* cited by examiner

ORGANIC LIGHT EMITTING DISPLAY AND DRIVING METHOD OF THE SAME

CROSS-REFERENCE TO RELATED APPLICATION

Korean Patent Application No. 10-2014-0170287, filed on Dec. 2, 2014, and entitled, "Organic Light Emitting Display and Driving Method Of the Same," is incorporated by reference herein in its entirety.

BACKGROUND

1. Field

One or more embodiments described herein relate to an organic light emitting display and a method for driving an organic light emitting display.

2. Description of the Related Art

An organic light emitting display has fast response speed and improved light emission efficiency, luminance, and viewing angle compared to other flat panel displays.

An organic light emitting displays generate images using pixels that emit light from organic light emitting diodes (OLEDs), which are self-luminous elements. Each pixel is connected to a data line and a scan line. The data line applies a data signal having emission information for the pixel. The scan line applies a scan signal, for example, to allow the data signals to be sequentially applied to the pixels.

In one type of organic light emitting display, pixels connected to a same data line are connected to different scan lines, and pixels connected to a same scan line are connected to different data lines. As a result, when the number of pixels in the display is increased to achieve higher resolution, the number of data lines or scan lines increases proportionally. As the number of data lines increases, the number of circuits in a data driver for generating and applying the data signals increases, which results in an increase in manufacturing costs.

Attempts have been made to reduce these costs. One attempt involves demultiplexing the data signals and then sequentially applying the data signals to the data lines. However, this attempt has proven to have significant drawbacks. One drawback relates to the inverse proportionality between one horizontal period and display resolution. Namely, a reduction of one horizontal period produces an increase in display resolution. The period in which the scan signal is to be applied in one horizontal period decreases under these circumstances.

A decrease in this period may prevent a compensation operation from being adequately performed for each pixel. For example, each pixel may include a compensation circuit to compensate the threshold voltage of its driving transistor. The compensation circuit may perform the compensating function in the period during which the scan signal is applied. However, when this period is reduced, a mura phenomenon may occur because it may be impossible to sufficiently compensate for the threshold voltages of the driving transistors in such a reduced period.

SUMMARY

In accordance with one or more embodiments, an organic light emitting display includes a plurality of pixels, each pixel including: an organic light emitting diode; a first transistor having a gate electrode connected to a scan line, a first electrode connected to a data line, and a second electrode connected to a first node; a second transistor to drive the organic light emitting diode based on a data signal provided through the first transistor; a first capacitor connected between the first node and a second node connected to a gate electrode of the second transistor; a second capacitor connected between the first node and a first power supply voltage; a third transistor connecting the first power supply voltage with a third node connected to the other electrode of the second transistor; a fourth transistor connecting one electrode of the second transistor with a fourth node connected to an anode electrode of the organic light emitting diode; a fifth transistor having one electrode connected to the first node and the other electrode connected to the third node; a sixth transistor having one electrode connected to a fifth node to which an initialization voltage is applied and the other electrode connected to the fourth node; and a seventh transistor connecting the second node with the fifth node.

A gate electrode of the fifth transistor, a gate electrode of the sixth transistor, and a gate electrode of the seventh transistor may be connected to a same control signal line. The pixels may be arranged in pixel row groups, and each pixel group includes a same number of pixel rows. The pixel row groups may be sequentially driven.

While data signals are input to pixels in one pixel row group, a threshold voltage may be compensated in pixels in another pixel row group adjacent to the one pixel row group. The threshold voltage compensation may be performed at substantially a same time in each of the pixel row groups. The first capacitor may be charged based on a voltage corresponding to a threshold voltage of the second transistor. A threshold voltage of the second transistor may be compensated based on the initialization voltage provided through the seventh transistor.

In accordance with one or more other embodiments, an organic light emitting display includes a plurality of pixels arranged in a plurality of pixel row groups, each pixel group including a same number of pixel rows; a scan driver to provide scan signals to the pixels; a data driver to generate data signals for the pixels; and a data distributor to demultiplex the data signals for input into the pixels, wherein the plurality of pixel row groups are sequentially driven, wherein data signals are to be input to the pixels after threshold voltage compensation is performed at substantially a same time for pixels in each of the pixel row groups, and wherein the data signals are to be input to pixels in one pixel row group while threshold voltage compensation is performed for pixels in another pixel row group adjacent to the one pixel row group.

Threshold voltage compensation may be performed at substantially a same time for pixels in each of the pixel row groups. Each of the pixels may include an organic light emitting diode, a first transistor to be turned on based on the scan signal to transmit the data signal provided through one electrode to another electrode, a second transistor to drive the organic light emitting diode based on a data signal provided through the first transistor, and a first capacitor connected between the other electrode of the first transistor and a gate electrode of the second transistor. The first capacitor may be charged with a voltage corresponding to a threshold voltage of the second transistor during threshold voltage compensation. The initialization voltage may be provided to the gate electrode of the second transistor before threshold voltage compensation, and a threshold voltage of the second transistor may be compensated based on the initialization voltage.

In accordance with one or more other embodiments, a method for driving an organic light emitting display includes applying an initialization voltage to pixels in one pixel row group; compensating a threshold voltage of a drive transistor of each of the pixels in one pixel row group; inputting a reference voltage to the pixels in one pixel row group; demultiplexing data signals and inputting the demultiplexed data signals to the pixels in one pixel row group; and controlling the pixels in one pixel row group to emit light, wherein the data signals are input to the pixels in one pixel row group while a threshold voltage is compensated in pixels in another pixel row group adjacent to the one pixel row group.

The compensating operation may include compensating the threshold voltage of the pixels in each of the pixel row groups at substantially a same time. The method may include applying a scan signal to turn on a first transistor to transmit the data signal provided through one electrode to another electrode of the first transistor, wherein a first capacitor is connected between the other electrode of the first transistor and a gate electrode of the drive transistor.

The compensating operation may include charging the first capacitor based on a voltage corresponding to the threshold voltage of the drive transistor. Each of the pixels may include a control transistor to connect the first transistor with the drive transistor. The data signal may be demultiplexed by a demultiplexing signal output during a gate-on period of a scan signal. The method may include applying the initialization voltage includes charging a gate electrode of the drive transistor based on the initialization voltage, and the compensating includes compensating the threshold voltage of the drive transistor based on the initialization voltage.

BRIEF DESCRIPTION OF THE DRAWINGS

Features will become apparent to those of skill in the art by describing in detail exemplary embodiments with reference to the attached drawings in which.

DETAILED DESCRIPTION

Figure 1:
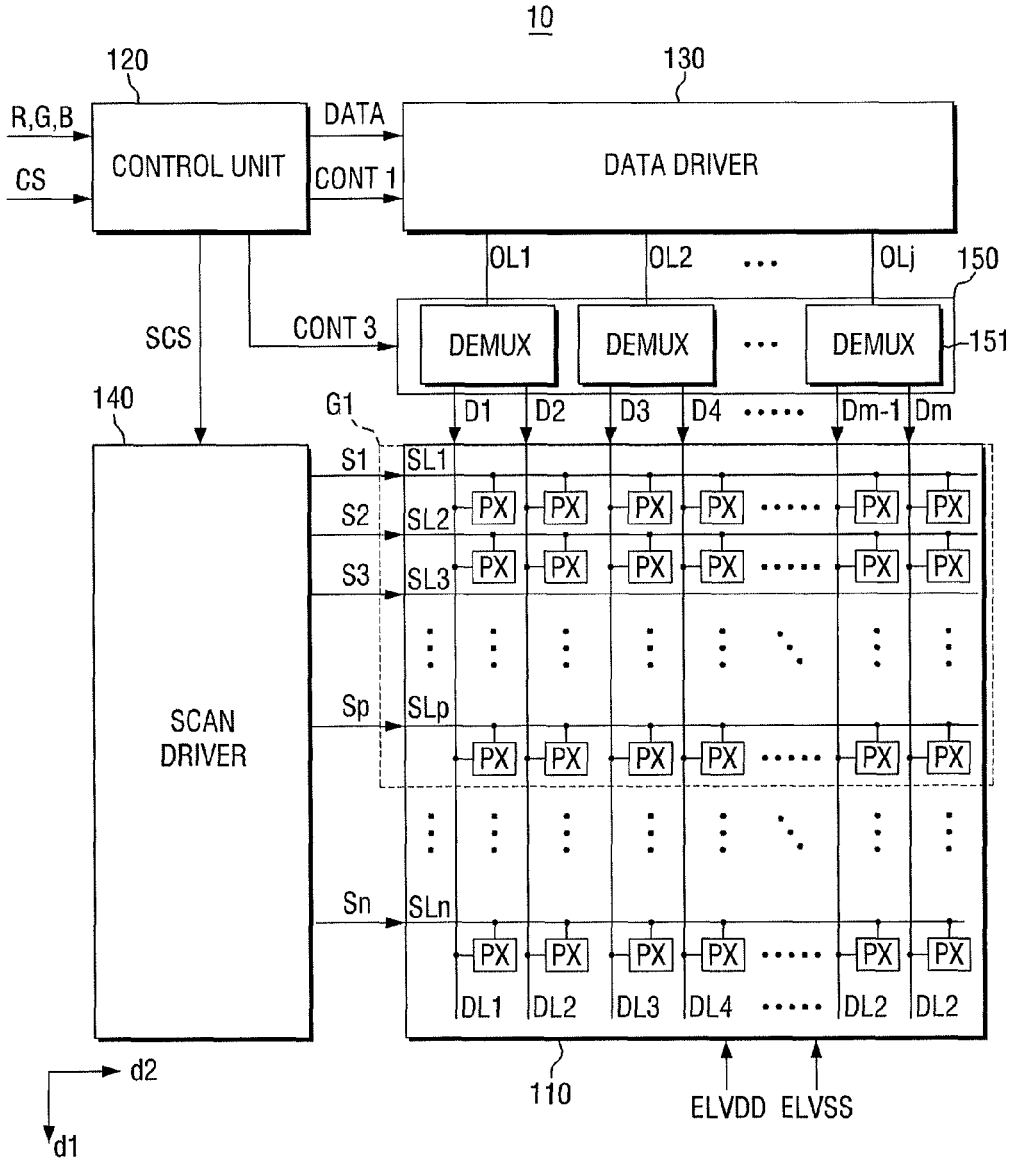
FIG. 1 illustrates an embodiment of an organic light emitting display.

Example embodiments are described more fully hereinafter with reference to the accompanying drawings; however, they may be embodied in different forms and should not be construed as limited to the embodiments set forth herein. Rather, these embodiments are provided so that this disclosure will be thorough and complete, and will fully convey exemplary implementations to those skilled in the art. Like reference numerals refer to like elements throughout. The embodiments may be combined to form additional embodiments.

Figure 2:
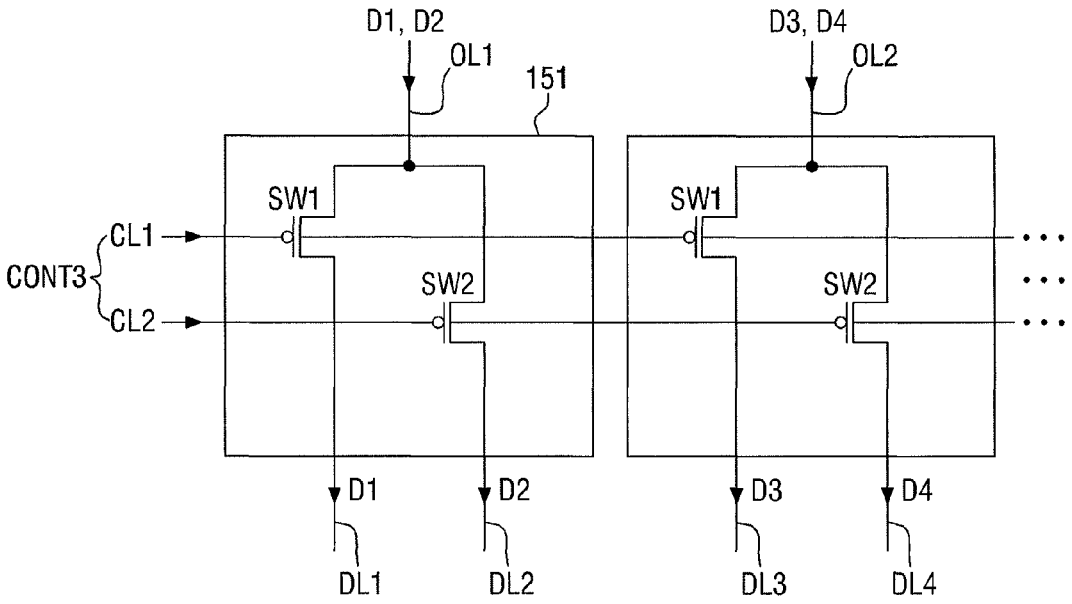
FIG. 2 illustrates an embodiment of a data distributor.
Figure 3:
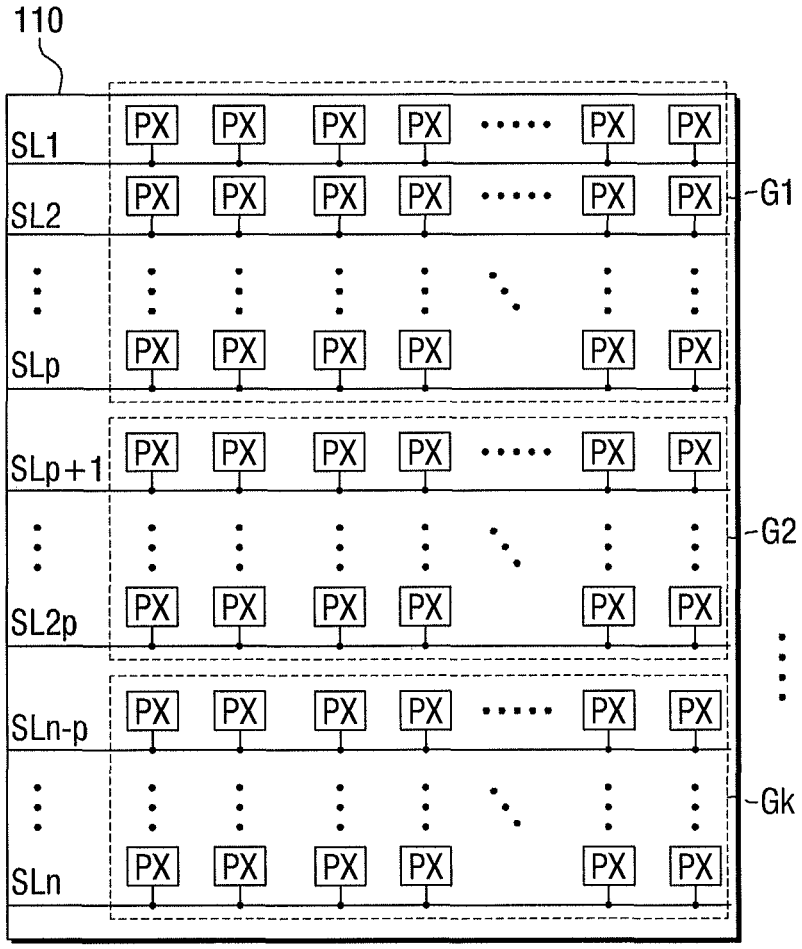
FIG. 3 illustrates an embodiment of a display unit.

FIG. 1 illustrates an embodiment of an organic light emitting display 10, FIG. 2 illustrates an embodiment of a data distributor 150, and FIG. 3 illustrates an embodiment of a display unit 110. Referring to FIGS. 1 to 3, the organic light emitting display 10 includes the display unit 110, a control unit 120, a data driver 130, a scan driver 140, and the data distributor 150.

The display unit 110 displays an image, and may include a plurality of scan lines SL1, SL2, . . . , SLn, a plurality of data lines DL1, DL2, . . . , DLm intersecting the scan lines SL1, SL2, . . . , SLn, and a plurality of pixels PX connected to the scan lines SL1, SL2, . . . , SLn and the data lines DL1, DL2, . . . , DLm, where n and m are natural numbers different from each other. The data lines DL1, DL2, . . . , DLm intersect the scan lines SL1, SL2, . . . , SLn, respectively. For example, the data lines DL1, DL2, . . . , DLm may extend in a first direction d1, and the scan lines SL1, SL2, . . . , SLn may extend in a second direction d2 intersecting the first direction d1. The first direction d1 may be a column direction, and the second direction d2 may be a row direction.

The scan lines SL1, SL2, . . . , SLn include first to nth scan lines SL1, SL2, . . . , SLn disposed sequentially in the first direction d1. The data lines DL1, DL2, . . . , DLm include first to mth data lines DL1, DL2, . . . , DLm disposed sequentially in the second direction d2.

The pixels PX are arranged in a matrix form. Each pixel PX is connected to one of the scan lines SL1, SL2, . . . , SLn and one of the data lines DL1, DL2, . . . , DLm. The pixels PX may receive data signals D1, D2, . . . , Dm applied to the data lines DL1, DL2, . . . , DLm corresponding to scan signals S1, S2, . . . , Sn from the scan lines SL1, SL2, . . . , SLn. For example, the scan lines SL1, SL2, . . . , SLn are provided with the scan signals S1, S2, . . . , Sn to be applied to the pixels PX. The data lines DL1, DL2, . . . , DLm are provided with the data signals D1, D2, . . . , Dm. Each pixel PX receives a first power supply voltage ELVDD through a first power line and a second power supply voltage ELVSS through a second power line. Further, each pixel PX may be connected to a first emission control line, a second emission control line, and a control line to control the light emission.

The control unit 120 receives a control signal CS and image signals R, G and B, for example, from an external source. The image signals R, G and B contain luminance information of the pixels PX. The luminance of light to be emitted from each pixel may have a predetermined number (e.g., 1024, 256, or 64) of gray levels.

The control signal CS may include a vertical synchronization signal Vsync, a horizontal synchronization signal Hsync, a data enable signal DE and a clock signal CLK. The control unit 120 may generate first to third drive control signals CONT1 to CONT3 and image data DATA in response to the image signals R, G and B and the control signal CS.

The control unit 120 may generate the image data DATA by dividing the image signals R, G and B on a frame basis based on the vertical synchronization signal Vsync, and dividing the image signals R, G and B on a scan-line basis based on the horizontal synchronization signal Hsync. The control unit 120 may compensate for the generated image data DATA. For example, the control unit 120 may compensate for the image data DATA to prevent deviation in luminance by sensing degradation information for each of the pixels (PX). A different type of data compensation may be performed in the control unit 120 in another embodiment.

The control unit 120 outputs the image data DATA and the first drive control signal CONT1 to the data driver 130. The control unit 120 transmits the second drive control signal CONT2 to the scan driver 140 and transmits the third drive control signal CONT3 to the data distributor 150.

The scan driver 140 is connected to the scan lines of the display unit 110 to generate the scan signals S1, S2, . . . , Sn based on the second drive control signal CONT2. The scan driver 140 may sequentially apply the scan signals S1, S2, . . . , Sn of a gate-on voltage to the scan lines.

The data driver 130 is connected to the data lines of the display unit 110 to generate the data signals D1, D2, . . . , Dm, for example, by sampling and holding the input image data DATA based on the first drive control signal CONT1, and then changing the image data to an analog voltage. The data driver 130 may output the data signals D1, D2, . . . , Dm to a plurality of output lines OL1, OL2, . . . , OLj. Each output line OL1, OL2, . . . , OLj may be connected to one of a plurality of demultiplexers 151 in the data distributor 150. For example, the data signals D1, D2, . . . , Dm generated in the data driver 130 may be respectively transmitted to the data lines DL1, DL2, . . . , DLm through the data distributor 150.

The data distributor 150 may include a plurality of demultiplexers 151. Each demultiplexer 151 may be connected to one of the output lines OL1, OL2, . . . , OLj. The demultiplexer 151 may be connected to at least two data lines which are arranged consecutively among the data lines DL1, DL2, . . . , DLm. For example, the demultiplexer 151 may selectively connect each of the output lines with the data lines based on a demultiplexing signal CL.

The demultiplexing signal CL may be included in the third drive control signal CONT3 output from the control unit 120. The third drive control signal CONT3 may include signals for controlling the initiation, termination, and operation of the data distributor 150. In this case, one demultiplexer 151 may selectively connect one output line with two data lines arranged consecutively. For example, one demultiplexer 151 may selectively connect the first output line OL1 with one of the first data line DL1 or the second data line DL2.

An adjacent demultiplexer 151 may selectively connect the second output line OL2 with one of the third data line DL3 and the fourth data line DL4. In this case, the first data signal D1 and the second data signal D2 may be provided as a combined signal to the first output line OL1, and may be demultiplexed in the demultiplexer 151 and sequentially applied to the first data line DL1 and the second data line DL2. The third data line D3 and the fourth data line D4 may be provided as a combined signal to the second output line OL2, and may be demultiplexed in the demultiplexer 151 and sequentially applied to the third data line DL3 and the fourth data line DL4.

The following description applies to demultiplexer 151 in the illustrative case where two data lines are switched. The number of the data lines that may be connected to the demultiplexer 151 and the structure of the demultiplexer 151 may be different in another embodiment.

FIG. 2 illustrates an embodiment of demultiplexer 151 connected to the first data line DL1 and the second data line DL2. The following description may be applied in substantially the same manner to the other demultiplexers 151 of the data distributor 150.

The demultiplexer 151 may include a first switch SW1 for controlling the connection of the first data line DL1 and the first output line OL1, and a second switch SW2 for controlling the connection of the second data line DL2 and the first output line OL1. The demultiplexer 151 may selectively provide a data signal supplied through the first output line OL1 to the first data line DL1 and the second data line DL2. The first switch SW1 may be activated by a first demultiplexing signal CL1 to connect the first data line DL1 and the first output line OL1. The second switch SW2 may be activated by a second demultiplexing signal CL2 to connect the second data line DL2 and the first output line OL1.

The first demultiplexing signal CL1 and the second demultiplexing signal CL2 may be sequentially output during a gate-on period of the scan signal. For example, the demultiplexer 151 may switch the first data line DL1 and the second data line DL2 during the gate-on period of the scan signal, and may output the first data signal D1 to the first data line DL1 and output the second data signal D2 to the second data line DL2.

Although the data distributor 150 and the data driver 130 have been illustrated as separate blocks, the data distributor 150 and the data driver 130 may be implemented in one circuit on a substrate on which the display unit 110 is formed in another embodiment. The organic light emitting display 10 according to the present embodiment includes the data distributor 150 constituted by a plurality of demultiplexers 151, and thus, may be designed such that the data driver 130 has a simpler configuration.

Each pixel PX may receive the scan signal applied from the scan driver 140 on a pixel row basis and may emit light at a brightness corresponding to the data signal applied through the data distributor 150.

As shown in FIG. 3, the pixels PX may be defined as including a plurality of pixel row groups G1, G2, . . . , Gk. Each of the pixel row groups G1, G2, . . . , Gk may include the same number of pixel rows. The pixel row groups G1, G2, . . . , Gk may be defined consecutively. The first pixel row group G1 may include pixel rows connected to the first scan line SL1 and pth scan line SLp. The second pixel row group G2 may include pixel rows connected to the (p+1)th scan line SLp+1 and 2pth scan line SL2*p*, where p is a natural number of 2 or more. In an exemplary embodiment, p may be 8. For example, the first pixel row group G1 may include a first pixel row connected to the first scan line SL1 to pth pixel row connected to the pth scan line SLp. The organic light emitting display 10 according to the present embodiment may be driven on the basis of the pixel row groups G1, G2, . . . , Gk.

Figure 4:
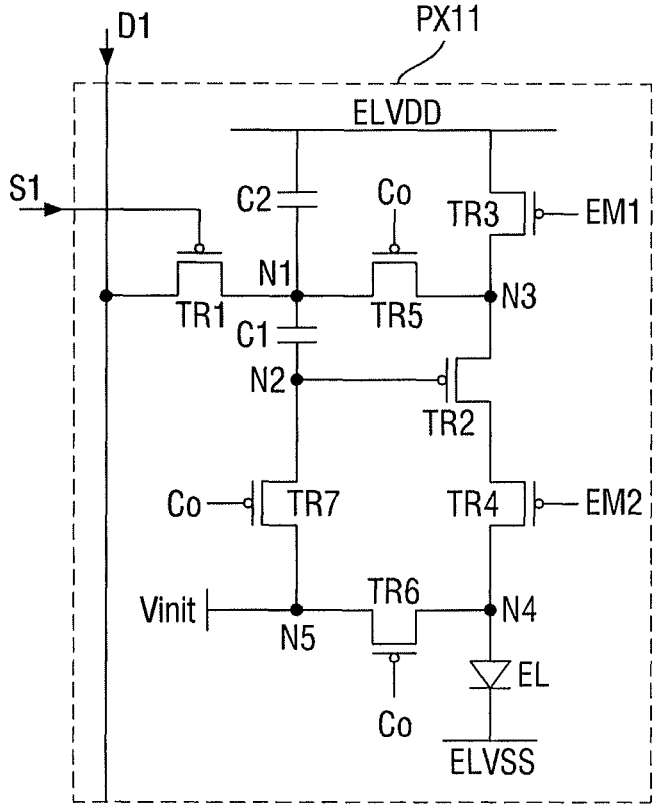
FIG. 4 illustrates an embodiment of a pixel.
Figure 5:
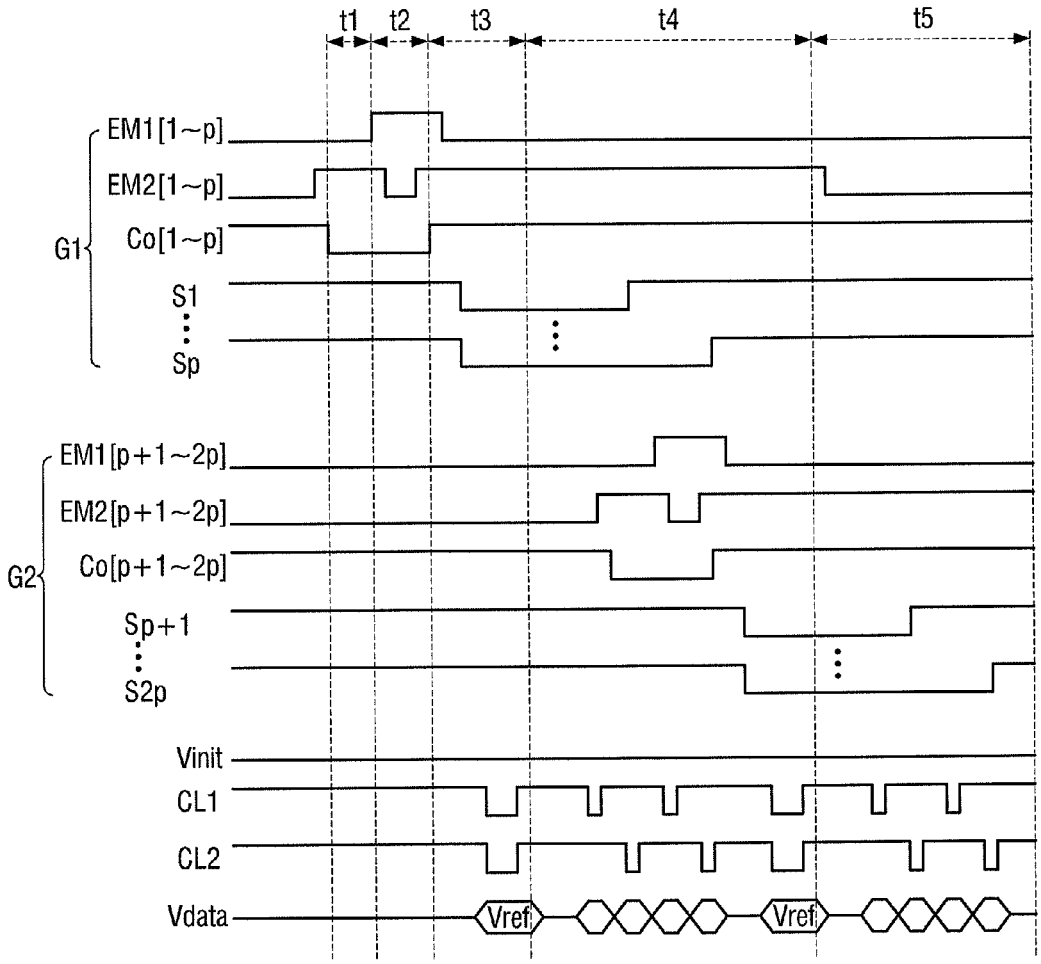
FIG. 5 illustrates control signals for the organic light emitting display.
Figure 6:
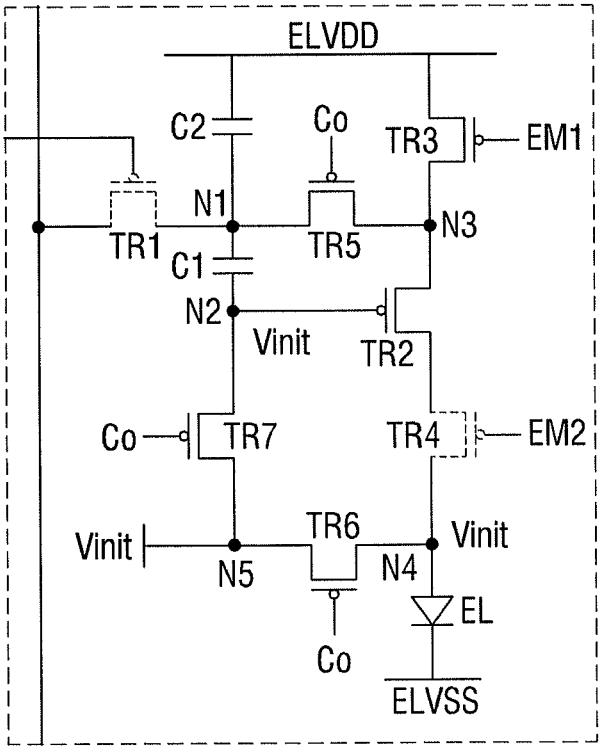
FIGS. 6-10 illustrate examples of how the pixel operates in different periods.
Figure 7:
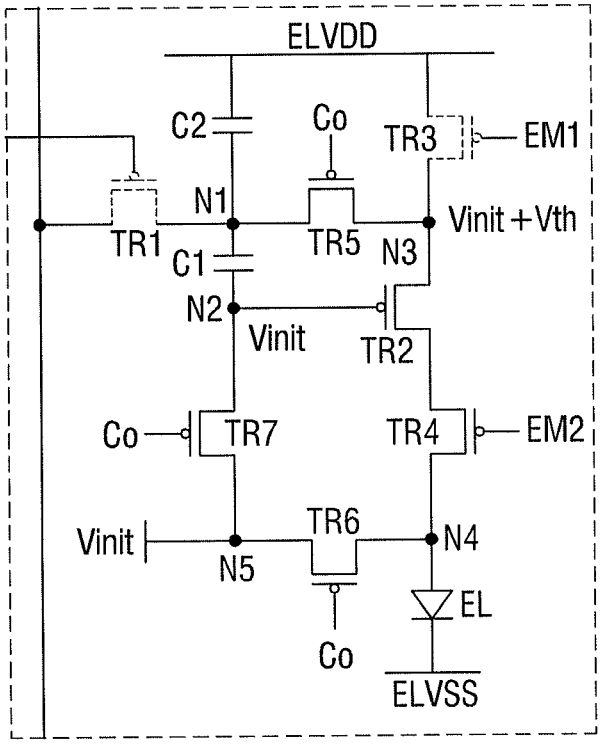
Figure 8:
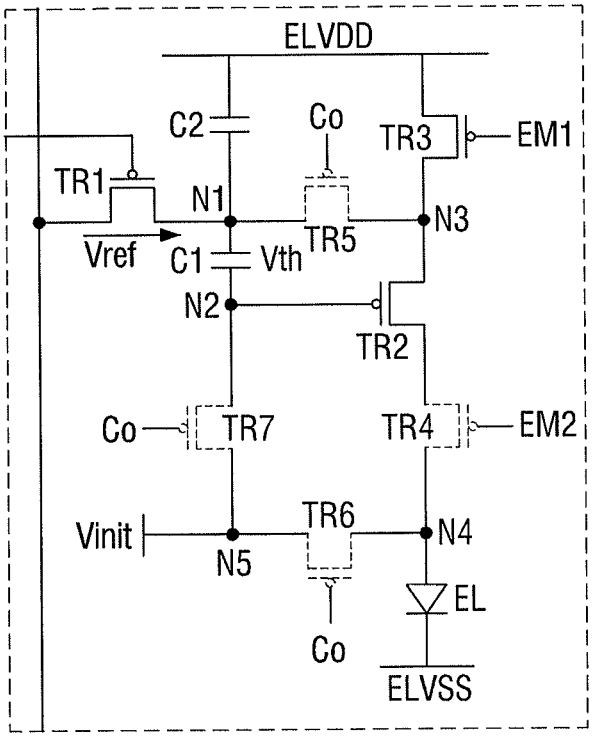
Figure 9:
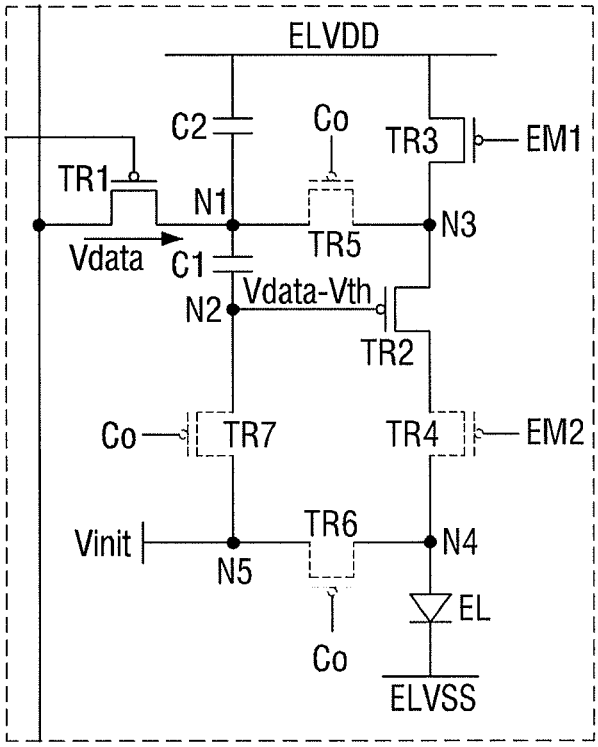
Figure 10:
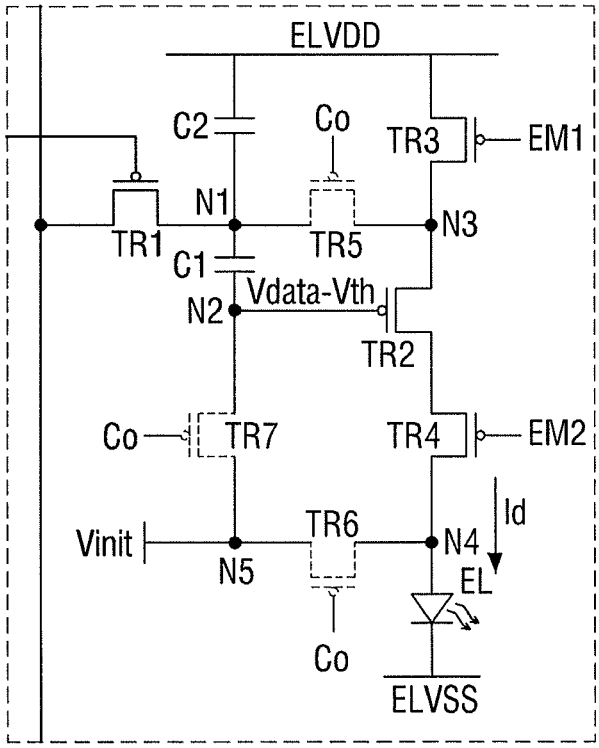

FIG. 4 illustrates an embodiment of a pixel PX11, which, for example, may be included in the organic light emitting display 10. FIG. 5 is a timing diagram illustrating an embodiment of control signals for the organic light emitting display 10. FIGS. 6 to 10 illustrate operations of the pixel in different period. In FIG. 4, a circuit of the pixel PX11 is connected to the first scan line SL1 and the first data line DL1, Other pixels may have the same or similar structure.

Referring to FIGS. 4 to 10, each pixel PX includes an organic light emitting diode EL, first to seventh transistors TR1 to TR7, a first capacitor C1, and a second capacitor C2. That is, each pixel PX has a 7T2C structure.

The first transistor TR1 may include a gate electrode connected to the first scan line SL1, one electrode connected to the first data line DL1 and the other electrode connected to the first node N1. The first transistor TR1 is turned on by the scan signal S1 of the gate-on voltage applied to the first scan line SL1, to transmit the data signal D1 from the first data line DL1 to the first node N1. The first transistor TR1 may be a switching transistor to selectively provide the data signal D1 to a drive transistor. The first transistor TR1 may be, for example, a p-channel field effect transistor, e.g., the first transistor TR1 may be turned on when the scan signal has a low-level voltage and may be turned off when the scan signal has a high-level voltage. In one embodiment, all of the second to seventh transistors TR2 to TR7 may be p-channel field effect transistors. In another embodiment, the first to seventh transistors TR1 to TR7 may be n-channel field effect transistors.

The first node N1 is connected to one electrode of the first capacitor C1, the other electrode of the second capacitor C2, and one electrode of the fifth transistor TR5. The other electrode of the first capacitor C1 is connected to the second node N2 connected to the gate electrode of the second transistor TR2. The first capacitor C1 may be connected between the first node N1 and the second node N2.

The second transistor TR2 may be a drive transistor which controls a drive current Id supplied to the organic light emitting diode EL from the first power supply voltage ELVDD, depending on the voltage level of the gate electrode. The second transistor TR2 includes a gate electrode connected to the second node N2, the other electrode connected to the third node N3, and one electrode connected to the fourth node N4. The third node N3 is connected to the first power supply voltage ELVDD, and the fourth node N4 is connected to an anode electrode of organic light emitting diode EL.

The third transistor TR3 controls the connection of the third node N3 and the first power supply voltage ELVDD. For example, the third transistor TR3 includes a gate electrode connected to the first emission control line, the other electrode connected to the first power supply voltage ELVDD, and one electrode connected to the third node N3. The third transistor TR3 is turned on by a first emission control signal EM1 to electrically connect the first power supply voltage ELVDD with the third node N3.

The fourth transistor TR4 may block the flow of the drive current Id. For example, the fourth transistor TR4 includes a gate electrode connected to the second emission control line, one electrode connected to the fourth node N4, and the other electrode connected to one electrode of the second transistor TR2. The fourth transistor TR4 may be a light emission control transistor to block the drive current Id from flowing to the organic light emitting diode EL based on a second emission control signal EM2.

The fifth transistor TR5 connects the first node N1 with the third node N3. The voltage level of the first node N1 and the third node N3 may be controlled by controlling the fifth transistor TR5.

Each of the sixth transistor TR6 and the seventh transistor TR7 may transmit an initialization voltage Vinit. One electrode of the sixth transistor TR6 may be connected to a fifth node N5 to which the initialization voltage Vinit is applied, and the other electrode of the sixth transistor TR7 may be connected to the second node N2 connected to the gate electrode of the drive transistor. Further, one electrode of the seventh transistor TR6 may be connected to the fifth node N5, and the other electrode of the seventh transistor TR6 may be connected to the fourth node N4. By controlling the sixth transistor TR6 and the seventh transistor TR7, the other electrode and the gate electrode of the second transistor TR2 may be initialized with the initialization voltage Vinit.

The gate electrode of the fifth transistor TR5, the gate electrode of the sixth transistor TR6, and the gate electrode of the seventh transistor TR7 may be connected to the same control line. For example, the fifth transistor TR5, the sixth transistor TR6, and the seventh transistor TR7 may be controlled by a same control signal Co provided through the control line. In another embodiment, the fifth transistor TR5, sixth transistor TR6, and seventh transistor TR7 may be controlled by different control signals.

The organic light emitting diode EL may include an organic light emitting layer between the anode electrode connected to the fourth node N4 and the cathode electrode connected to the second power supply voltage ELVSS. The organic light emitting layer may emit light in one of a plurality of primary colors, e.g., red, green and blue. A desired color may be displayed based on the spatial sum or temporal sum of the three primary colors. The organic light emitting layer may include, for example, a low molecular organic material or a polymer organic material corresponding to each color. The organic material corresponding to each color may emit light according to the amount of current flowing through the organic light emitting layer.

The first pixel row group G1 and the second pixel row group G2 may be operated as illustrated in the timing diagram of FIG. 5. The first pixel row group G1 may include a plurality of pixel rows connected to the first scan line SL1 to pth scan line SLp. The second pixel row group G2 may include a plurality of pixel rows connected to the p+1th scan line SLp+1 to 2pth scan line SL2*p*. The first pixel row group G1 and the second pixel row group G2 may be sequentially operated.

Further, in the organic light emitting display according to the present embodiment, the time for inputting the data signals and the time for compensating for the threshold voltage may be separated from each other. For example, while the data signals are input to the first pixel row group G1, initialization and compensation of the threshold voltage may be performed on the second pixel row group G2. Accordingly, the time for compensating for the threshold voltage may be sufficiently ensured. This will be described in more detail in conjunction with the operation of the first pixel row group G1. The operation process of the first pixel row group G1 may be applied in the same way to the other pixel row groups.

The operation period of the first pixel row group G1 may be divided into a first period t1 to a fifth period t5. The first period t1 may be an initialization period, the second period t2 may be a period for compensating a threshold voltage of the drive transistor, the third period t3 may be a period for applying a reference voltage, the fourth period t4 may be a period for inputting a data signal, and the fifth period t5 may be a light emission period. In this example, the voltage provided to each data line in response to the data signal is referred to as a data voltage Vdata.

FIGS. 6 to 10 illustrate examples of how the pixel PX11 operates in the first period t1 to the fifth period t5, respectively. The transistor represented by a solid line may indicate a transistor in a turned-on state, and the transistor represented by a dotted line may indicate a transistor in a turned-off state. Further, in the timing diagram of FIG. 5, the first emission control signal EM1, the second emission control signal EM2, and a first control signal Co1 may be applied at the same timing to the pixels in each pixel row group. Accordingly, operation of the pixels may be changed at the same time in response to the control signals.

In the first period t1, first to pth scan signals S1 to Sp may be provided at a high level, and the first transistor TR1 may be in the turned-off state. The second emission control signal EM2 may also be provided at a high level, and the fourth transistor TR4 may be in the turned-off state. In this case, the first emission control signal EM1 and the first control signal Co1 may be provided at a low level at which each transistor can be turned on, i.e., the third transistor TR3 and the fifth to seventh transistors TR5, TR6 and TR7 of the pixels in the first pixel row group G1 are turned on. Accordingly, the third node N3 may be charged to the voltage level of the first power supply voltage ELVDD, and the second node N2 and the fourth node N4 may be initialized based on the initialization voltage Vinit.

In the second period t2, the first control signal Co1 may still be provided at a low level, but the first emission control signal EM1 may be changed to the high level. Accordingly, the third transistor TR3 may be turned off and the third node N3 may be floating. Further, in the second period t2, the second emission control signal EM2 may be provided at a low level for a predetermined period to turn on the fourth transistor TR4. The voltage of the third node N3 may be discharged through the second transistor TR2, e.g., the drive transistor. Then, when the voltage of the third node N3 becomes Vinit+Vth, the second transistor TR2 may be turned off and the voltage of the third node N3 may no longer be discharged from Vinit+Vth. For example, the threshold voltage Vth may be compensated for at the third node N3. The voltage level of the first node N1 may also be Vinit+Vth, and a voltage corresponding to Vth may be stored in the first capacitor C1.

In this case, a reference voltage in the compensation of the threshold voltage Vth may be Vinit, which may be independent of the data voltage Vdata supplied through the data line. Since compensation of the threshold voltage Vth is performed independently from charging the data voltage Vdata, the compensation of the threshold voltage of the second pixel row group G2 may be performed at the time of inputting the data voltage of the first pixel row group G1. Accordingly, it is possible to ensure sufficient time for compensation, and thus to prevent the display quality from being degraded due to insufficient compensation of the threshold voltage.

In the third period t3, a reference voltage Vref may be applied. In this case, all of the first to pth scan signals S1 to Sp may be provided at a low level, and the first transistor TR1 may be turned on. Further, both of the first demultiplexing signal CL1 and the second demultiplexing signal CL2 may be provided at a low level, and the reference voltage Vref may be provided to a plurality of data lines. In this case, the reference voltage Vref may be a reference voltage when the data voltage Vdata is applied. For example, the level of the data voltage Vdata to be applied may be determined based on the reference voltage Vref. Then, the control signal Co is changed to the high level, and the fifth to seventh transistors TR5, TR6 and TR7 may be turned off.

Further, the first emission control signal EM1 may be changed again to the low level, and the voltage of the third node N3 may be first power supply voltage ELVDD as the third transistor TR3 is turned on. The reference voltage Vref may be charged to the first node N1. The first capacitor C1 may change the voltage of the second node N2 according to the voltage change of the first node N1, e.g., the second node N2 may be changed to Vref−Vth.

In the fourth period t4, the first to pth scan signals S1 to Sp may be provided sequentially. For example, the pixel rows in the first pixel row group G1 may be turned on sequentially to receive the data voltage Vdata. In this case, the data voltage Vdata may be demultiplexed and distributed to each data line. For example, the data voltage Vdata may be applied to different data lines by time division in accordance with a demultiplexing signal.

During a period in which the gate-on voltage of a low level is applied from the first scan signal S1, the first demultiplexing signal CL1, and the second demultiplexing signal CL2 may be outputted sequentially. The first demultiplexing signal CL1 and the second demultiplexing signal CL2 may be provided to each of the demultiplexers 151 in the data distributor 150. Each of the demultiplexers 151 may connect each output line to the data line in response to the signal. For example, based on the low level voltage of the first demultiplexing signal CL1, the first switch SW1 of FIG. 2 may connect the first output line OL1 with the first data line DL1 to transmit the data signal. Based on the low level voltage of the second demultiplexing signal CL2, the second switch SW2 of FIG. 2 may connect the first output line OL1 with the second data line DL2 to transmit the data signal.

The second scan signal S2 may be output successively after the first scan signal S1 is output, and the first demultiplexing signal CL1 and the second demultiplexing signal CL2 corresponding to the second scan signal S2 may be output. Thus, the demultiplexing signals may be sequentially outputted corresponding to the scan signals sequentially provided.

The first transistor TR1 of each pixel may be turned on by the scan signal, and the data voltage Vdata may be supplied to the first node N1. The data voltage Vdata may be charged to the first node N1. The first capacitor C1 may change the voltage of the second node N2 according to the voltage change of the first node N1, e.g., the second node N2 may be changed to Vdata−Vth.

The fifth period t5 may be a light emission period. For example, the second emission control signal EM2 may be changed to the low level, and the second transistor TR2 may supply the drive current Id to the organic light emitting diode EL based on the voltage of the second node N2. In this case, the drive current Id supplied to the organic light emitting diode EL from the second transistor TR2 may be $(1/2)\times K(Vsg-Vth)$, where K is a constant value determined by the parasitic capacitance and mobility of the second transistor TR2, Vg is Vdata+Vth that is a voltage of the second node N2, Vs is be ELVDD that is a voltage of the third node N3, and Vsg is Vs−Vg.

Thus, the drive current may have a magnitude corresponding to the data voltage Vdata in a state where influence of the threshold voltage Vth is excluded. For example, in the organic light emitting display according to the present embodiment, compensating for deviation in characteristics of the second transistor TR2 allows for a reduction in a deviation in luminance between the pixels PX. In the fifth period t5, a change of the emission control signal EM may be carried out at the same time on the pixels in each pixel group, and the pixels in each pixel group may emit light at the same time.

In the organic light emitting display according to the present embodiment, since the compensation of the threshold voltage is performed at the same time for each pixel row block, it is possible to save the time required for performing compensation of the threshold voltage. Thus, it is possible to ensure sufficient time for applying the scan signal. Further, the organic light emitting display according to the present embodiment may perform initialization and compensation of the threshold voltage for one pixel row block while the data signals are input to another pixel row block. Accordingly, it is possible to provide sufficient time required for initialization and compensation of the threshold voltage. Thus, the organic light emitting display may achieve improved display quality.

Figure 11:
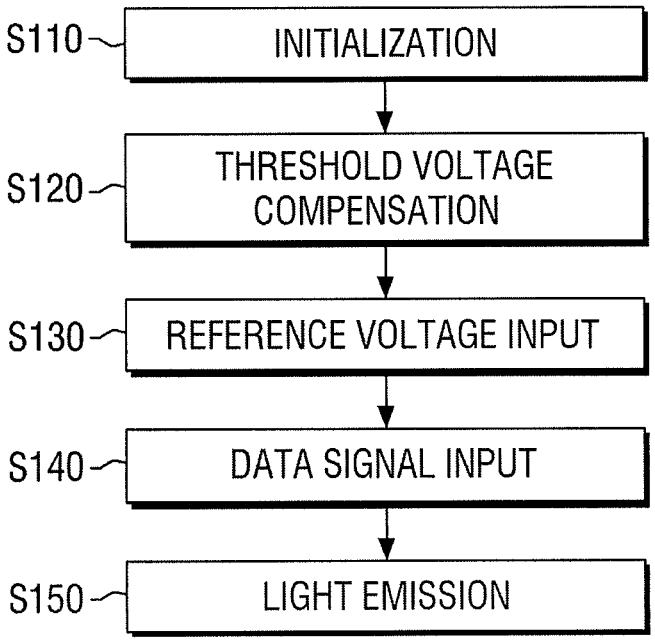
FIG. 11 illustrates an embodiment of a method for driving an organic light emitting display.

FIG. 11 illustrates an embodiment of a method for driving an organic light emitting display, which, for example, may be the displayed corresponding to FIGS. 1 to 10. The method includes an initialization operation S110, a threshold voltage compensation operation S120, a reference voltage input operation S130, a data signal input operation S140, and a light emission operation S150. In this method, the pixels PX are arranged in a matrix and may be defined to include a plurality of pixel row groups G1, G2, . . . , Gk, each including the same number of pixel rows.

In this case, each pixel may include the organic light emitting diode EL and the drive transistor TR2 for driving the organic light emitting diode EL. Each pixel row group may be driven individually, e.g., the pixel row groups may be driven sequentially. For example, the first pixel row group G1 and the second pixel row group G2, which are arranged consecutively, may be operated sequentially. While the data signals are input to the first pixel row group G1, the second pixel row group G2 may perform the initialization operation and the threshold voltage compensation operation. The driving method will now be described in conjunction with the first pixel row group G1.

The method includes applying the initialization voltage Vinit (S110). The initialization voltage Vinit may be provided to the pixels in the first pixel row group G1. For example, the voltage level of the gate terminal of the drive transistor TR2 and the anode terminal of the organic light emitting diode EL may be initialized by being charged with the initialization voltage. The configuration of providing the initialization voltage may be the one in FIG. 4 or another configuration. The initialization voltage Vinit may be provided at the same time to the pixels in the first pixel row group G1. The initialization voltage applying operation S110 may be performed at the same time in the pixels included in the first pixel row group G1.

Next, the threshold voltage Vth is compensated (S120). Compensation of the threshold voltage Vth of the drive transistor TR2 may be performed at the same time in the pixels in the first pixel row group G1. In this case, a reference voltage in the compensation of the threshold voltage Vth may be Vinit, which may be independent of the data voltage Vdata supplied through the data line. Since compensation of the threshold voltage Vth is performed independently from charging the data voltage Vdata, the compensation of the threshold voltage of the second pixel row group G2 may be performed at the time of inputting the data signals of the first pixel row group G1. Accordingly, it is possible to ensure sufficient time for compensation and to prevent the display quality from being degraded due to insufficient compensation of the threshold voltage.

The threshold voltage Vth may be compensated at the same time in the pixels in each pixel row group. Each pixel may include at least the organic light emitting diode EL, the first transistor TR1 which is turned on by the scan signal to transmit the data signal provided through one electrode to the other electrode, and the first capacitor C1 connected between the other electrode of the first transistor TR1 and the gate electrode of the drive transistor TR2. The first capacitor C1 may be connected between the first node N1 connected to the other electrode of the first transistor TR1 and the second node N2 connected to the gate electrode of the drive transistor TR2. The first capacitor C1 may be charged with a voltage corresponding to the threshold voltage Vth of the drive transistor TR2. The voltage of the first node N1 may be Vinit+Vth, and the voltage of the second node N2 may be Vinit. The threshold voltage compensation operation S120 may be substantially the same as the second period t2, or may be different in another embodiment.

Next, the reference voltage is input (S130). In this case, all of the first to pth scan signals S1 to Sp may be provided at a low level to turn on the first transistor TR1. Further, both of the first demultiplexing signal CL1 and the second demultiplexing signal CL2 may be provided at a low level, and the reference voltage Vref may be provided to a plurality of data lines. In this case, the reference voltage Vref may be a reference voltage when the data voltage Vdata is applied, e.g., the level of the data voltage Vdata to be applied may be determined based on the reference voltage Vref. The reference voltage Vref may be charged to the first node N1. The first capacitor C1 may change the voltage of the second node N2 according to the voltage change of the first node N1. Thus, the voltage level of the second node N2 may be changed to Vref−Vth.

Next, the data signals are input (S140). The data signals may be generated by the data driver 130 and transmitted to the data distributor 150. The data distributor 150 may include a plurality of demultiplexers 151. Each of the demultiplexers 151 may be connected to at least two data lines which are arranged consecutively among the data lines DL1, DL2, . . . , DLm. A plurality of data lines may be respectively connected to the pixels in one pixel row. For example, the data signals may be provided to the data distributor 150 in a state in which the signals to be provided to each data line are combined, and may be demultiplexed by the demultiplexer 151 and distributed to each data line. The voltage corresponding to the data signal is defined as the data voltage Vdata.

The first to pth scan signals S1 to Sp may be provided sequentially. For example, the pixel rows in the first pixel row group G1 may be turned on sequentially to receive the data voltage Vdata. In this case, the data voltage Vdata may be demultiplexed and distributed to each data line. For example, the data voltage Vdata may be applied to different data lines by time division in accordance with a demultiplexing signal.

During a period in which the gate-on voltage of a low level is applied from the first scan signal S1, the first demultiplexing signal CL1 and the second demultiplexing signal CL2 may be output sequentially. The first demultiplexing signal CL1 and the second demultiplexing signal CL2 may be provided to each of the demultiplexers 151 included in the data distributor 150, and each of the demultiplexers 151 may connect each output line to the data line in response to the signal. Thus, based on the low level voltage of the first demultiplexing signal CL1, the first switch SW1 of FIG. 2 may connect the first output line OL1 with the first data line DL1 to transmit the data signal. Based on the low level voltage of the second demultiplexing signal CL2, the second switch SW2 of FIG. 2 may connect the first output line OL1 with the second data line DL2 to transmit the data signal.

The second scan signal S2 may be outputted successively after the first scan signal S1 is output, and the first demultiplexing signal CL1 and the second demultiplexing signal CL2 corresponding to the second scan signal S2 may be output. Thus, the demultiplexing signals may be sequentially outputted corresponding to the scan signals sequentially provided.

The first transistor TR1 of each pixel may be turned on by the scan signal, and the data voltage Vdata may be supplied to the first node N1. The data voltage Vdata may be charged to the first node N1. The first capacitor C1 may change the voltage of the second node N2 according to the voltage change of the first node N1, e.g., the second node N2 may be changed to Vdata−Vth.

Next, the organic light emitting diode is caused to emit light (S150). In this operation, the drive transistor TR2 and the organic light emitting diode EL may be electrically connected to each other, and the drive transistor TR2 may supply the drive current Id to the organic light emitting diode EL in response to the voltage of the gate terminal. The drive transistor TR2 may reduce or minimize a deviation in luminance between the pixels PX in a state in which an influence of the threshold voltage Vth is excluded.

The control units, drivers, demultiplexers, and other processing features of the aforementioned embodiments may be implemented in logic which, for example, may include hardware, software, or both. When implemented at least partially in hardware, the control units, drivers, demultiplexers, and other processing features may be, for example, any one of a variety of integrated circuits including but not limited to an application-specific integrated circuit, a field-programmable gate array, a combination of logic gates, a system-on-chip, a microprocessor, or another type of processing or control circuit.

When implemented in at least partially in software, the control units, drivers, demultiplexers, and other processing features may include, for example, a memory or other storage device for storing code or instructions to be executed, for example, by a computer, processor, microprocessor, controller, or other signal processing device. The computer, processor, microprocessor, controller, or other signal processing device may be those described herein or one in addition to the elements described herein. Because the algorithms that form the basis of the methods (or operations of the computer, processor, microprocessor, controller, or other signal processing device) are described in detail, the code or instructions for implementing the operations of the method embodiments may transform the computer, processor, controller, or other signal processing device into a special-purpose processor for performing the methods described herein.

By way of summation and review, attempts have been made to reduce these costs. One attempt involves demultiplexing the data signals and then sequentially applying the data signals to the data lines. However, this attempt has proven to have significant drawbacks. One drawback relates to the inverse proportionality between one horizontal period and display resolution. Namely, a reduction of one horizontal period produces an increase in display resolution. The period in which the scan signal is to be applied in one horizontal period decreases under these circumstances.

A decrease in this period may prevent a compensation operation from being adequately performed for each pixel. For example, each pixel may include a compensation circuit to compensate the threshold voltage of its driving transistor. The compensation circuit may perform the compensating function in the period during which the scan signal is applied. However, when this period is reduced, a mura phenomenon may occur because it may be impossible to sufficiently compensate for the threshold voltages of the driving transistors in such a reduced period.

In accordance with one or more of the aforementioned embodiments, compensation of the threshold voltage is performed at the same time for each pixel row block. Therefore, it is possible to reduce time in order to allow compensation of the threshold voltage to be accurately performed. Thus, it is possible to ensure sufficient time for applying the scan signal.

Further, while the data signals are input to one pixel row block, it is possible to perform initialization and compensation of the threshold voltage for the next pixel row block. Accordingly, it is possible to provide sufficient time for initialization and compensation of the threshold voltage, thereby improving display quality.

Example embodiments have been disclosed herein, and although specific terms are employed, they are used and are to be interpreted in a generic and descriptive sense only and not for purpose of limitation. In some instances, as would be apparent to one of skill in the art as of the filing of the present application, features, characteristics, and/or elements described in connection with a particular embodiment may be used singly or in combination with features, characteristics, and/or elements described in connection with other embodiments unless otherwise indicated. Accordingly, it will be understood by those of skill in the art that various changes in form and details may be made without departing from the spirit and scope of the present invention as set forth in the following claims.

What is claimed is:

1. An organic light emitting display, comprising:

a plurality of pixels, each pixel including:

an organic light emitting diode;

a first transistor having a gate electrode connected to a scan line, a first electrode connected to a data line, and a second electrode connected to a first node;

a second transistor to drive the organic light emitting diode based on a data signal provided through the first transistor;

a first capacitor connected between the first node and a second node connected to a gate electrode of the second transistor;

a second capacitor connected between the first node and a first power supply voltage;

a third transistor connecting the first power supply voltage with a third node connected to another electrode of the second transistor;

a fourth transistor connecting one electrode of the second transistor with a fourth node connected to an anode electrode of the organic light emitting diode;

a fifth transistor having one electrode connected to the first node and the other electrode connected to the third node;

a sixth transistor having one electrode connected to a fifth node to which an initialization voltage is applied and the other electrode connected to the fourth node; and a seventh transistor connecting the second node with the fifth node.

2. The display as claimed in claim 1, wherein a gate electrode of the fifth transistor, a gate electrode of the sixth transistor, and a gate electrode of the seventh transistor are connected to a same control signal line.

3. The display as claimed in claim 1, wherein:

the pixels are arranged in pixel row groups, and each pixel group includes a same number of pixel rows.

4. The display as claimed in claim 3, wherein the pixel row groups are to be sequentially driven.

5. The display as claimed in claim 3, wherein:

while data signals are input to pixels in one pixel row group, a threshold voltage is to be compensated in pixels in another pixel row group adjacent to the one pixel row group.

6. The display as claimed in claim 3, wherein threshold voltage compensation is to be performed at substantially a same time in each of the pixel row groups.

7. The display as claimed in claim 1, wherein the first capacitor is to be charged based on a voltage corresponding to a threshold voltage of the second transistor.

8. The display as claimed in claim 1, wherein a threshold voltage of the second transistor is to be compensated based on the initialization voltage provided through the seventh transistor.

9. An organic light emitting display, comprising:

a plurality of pixels arranged in a plurality of pixel row groups, each pixel group including a same number of pixel rows;

a scan driver to provide scan signals to the pixels in the pixel row groups;

a data driver to generate data signals for the pixels in the pixel row groups; and a data distributor to demultiplex the data signals for input into the pixels in the pixel row groups, wherein the pixel row groups are sequentially driven, wherein data signals are to be input to the pixels after threshold voltage compensation is performed at substantially a same time for the pixels in each of the pixel row groups, threshold voltage compensation to be performed based on first and second control signals, the first control signal having a same value and the second control signal having different values for threshold voltage compensation and initialization of the pixels in each of the pixel row groups, and wherein the data signals are to be input to pixels in one pixel row group while threshold voltage compensation is performed for pixels in another pixel row group adjacent to the one pixel row group.

10. The display as claimed in claim 9, wherein threshold voltage compensation is to be performed at substantially a same time for pixels in each of the pixel row groups.

11. The display as claimed in claim 9, wherein each of the pixels includes:

an organic light emitting diode, a first transistor to be turned on based on the scan signal to transmit the data signal provided through one electrode to another electrode, a second transistor to drive the organic light emitting diode based on a data signal provided through the first transistor, and a first capacitor connected between the another electrode of the first transistor and a gate electrode of the second transistor.

12. The display as claimed in claim 11, wherein the first capacitor is to be charged with a voltage corresponding to a threshold voltage of the second transistor during threshold voltage compensation.

13. The display as claimed in claim 11, wherein:

an initialization voltage is to be provided to the gate electrode of the second transistor before threshold voltage compensation, and a threshold voltage of the second transistor is to be compensated based on the initialization voltage.

14. A method for driving an organic light emitting display, the method comprising:

applying an initialization voltage to pixels in one pixel row group;

compensating a threshold voltage of a drive transistor of each of the pixels in one pixel row group;

inputting a reference voltage to the pixels in the one pixel row group;

demultiplexing data signals and inputting the demultiplexed data signals to the pixels in the one pixel row group; and controlling the pixels in the one pixel row group to emit light, wherein the initialization voltage and the threshold voltage for the pixels in the pixel row group are applied based on first control signal having a same value for applying the initialization and threshold voltages and a second control signal having different values for applying the initialization and threshold voltages, wherein the data signals are input to the pixels in the one pixel row group while a threshold voltage is compensated in pixels in another pixel row group adjacent to the one pixel row group.

15. The method as claimed in claim 14, wherein the compensating includes:

compensating the threshold voltage of the pixels in each of the pixel row groups at substantially a same time.

16. The method as claimed in claim 14, further comprising:

applying a scan signal to turn on a first transistor to transmit one of the data signals provided through one electrode to another electrode of the first transistor, wherein a first capacitor is connected between the other electrode of the first transistor and a gate electrode of the drive transistor.

17. The method as claimed in claim 16, wherein the compensating includes:

charging the first capacitor based on a voltage corresponding to the threshold voltage of the drive transistor.

18. The method as claimed in claim 16, wherein each of the pixels includes a control transistor to control flow of current from the drive transistor to an organic light emitting diode.

19. The method as claimed in claim 14, wherein the data signal is demultiplexed by a demultiplexer which is controlled by a demultiplexing signal output during a gate-on period of a scan signal.

20. The method as claimed in claim 14, wherein:

applying the initialization voltage includes charging a gate electrode of the drive transistor based on the initialization voltage, and the compensating includes compensating the threshold voltage of the drive transistor based on the initialization voltage.

* * * * *